United States Patent [19]

von der Eltz

[11] 4,041,559

[45] Aug. 16, 1977

[54] PROCESS FOR THE CONTINUOUS WET TREATMENT OF TEXTILE MATERIAL IN ROPE FORM

[75] Inventor: Hans-Ulrich von der Eltz, Frankfurt am Main, Germany

[73] Assignee: Hoechst Aktiengesellschaft, Frankfurt am Main, Germany

[21] Appl. No.: 716,241

[22] Filed: Aug. 20, 1976

[30] Foreign Application Priority Data

Aug. 23, 1973 Germany ..... 2537615

[51] Int. Cl.[2] ..... D06B 3/26; D06B 3/28; D06B 21/00; D06B 23/18

[52] U.S. Cl. ..... 8/149.1; 8/152; 68/5 E; 68/178; 68/181 R

[58] Field of Search ..... 8/149.1, 149.2, 149.3, 8/152; 68/5 D, 5 E, 177, 178, 179, 181 R

[56] References Cited

U.S. PATENT DOCUMENTS

| | | | |
|---|---|---|---|
| 1,107,160 | 8/1914 | Macadam | 68/177 X |
| 1,403,126 | 1/1922 | Lyth | 68/179 X |
| 2,712,977 | 7/1955 | Keggin | 68/181 R X |
| 3,981,162 | 9/1976 | Klier | 68/5 E |

*Primary Examiner*—Philip R. Coe

*Attorney, Agent, or Firm*—Curtis, Morris & Safford

[57] ABSTRACT

A continuous process for the wet treatment of textile material in the form of endless ropes and for dwelling the textile a certain period under high temperature (HT) conditions, which comprises introducing the material in curls into the long leg of a vertically positioned, U-shaped tubular tunnel having legs of different length, impregnating the textile under atmospheric pressure with hot treatment liquor that is ejected at a high flow rate by means of spraying nozzles which are positioned at the top and at additional locations further down the descending long leg of the tubular tunnel, conveying the textile along the bent portion of the tubular tunnel under the hydrostatic pressure exerted on the material by the weight of the liquid column in the long leg, conveying the textile from the short leg of the tubular tunnel into a pressure-tight reaction and fixing chamber through at least two pressure locks placed one behind the other at the entrance of the reaction and fixing chamber, allowing the textile to dwell during its passage through the reaction and fixing chamber under the action of a HT vapor atmosphere in stored condition, and finally withdrawing the textile from the reaction and fixing chamber through at least two other pressure locks is disclosed.

1 Claim, 1 Drawing Figure

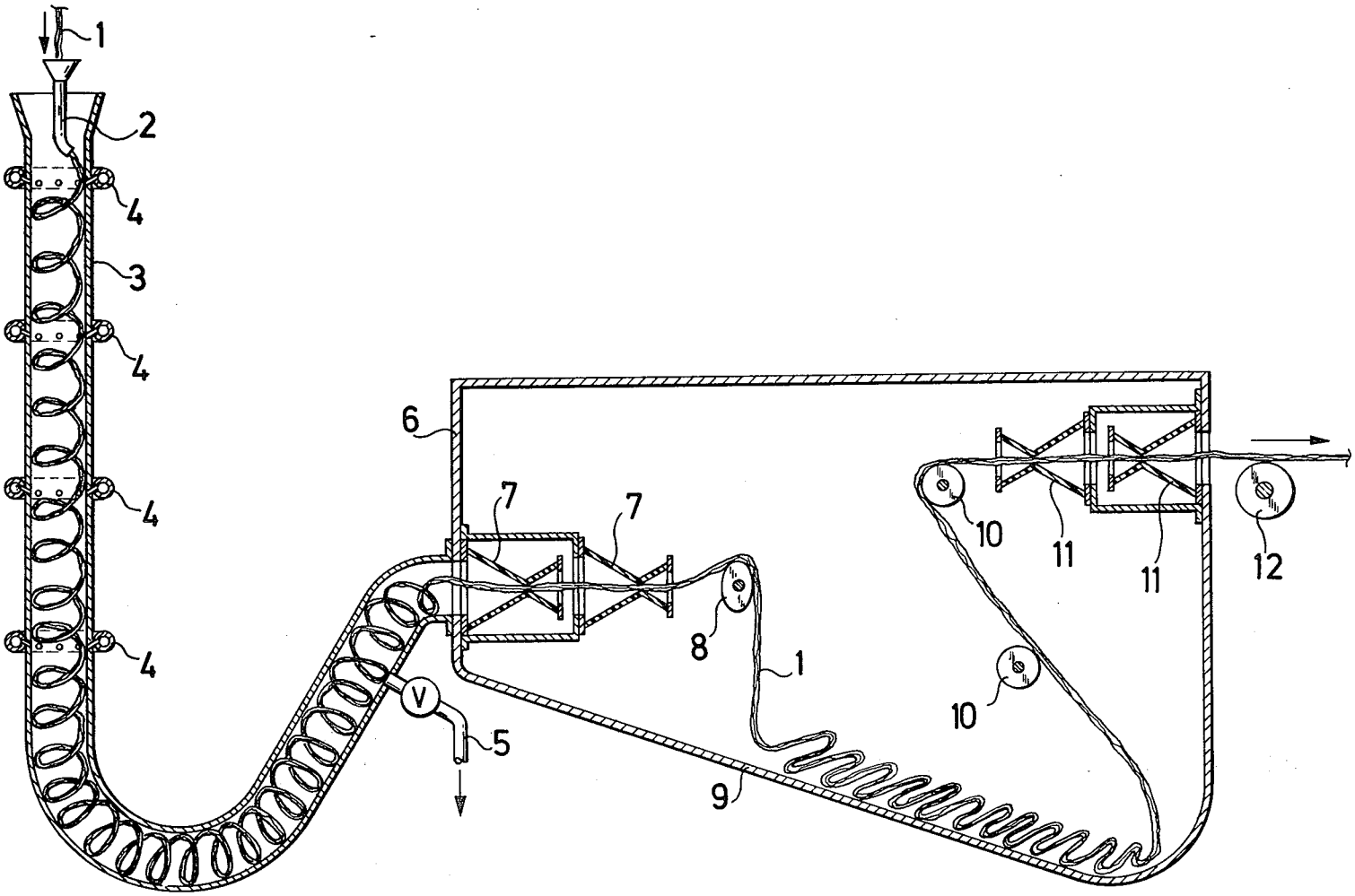
1
2
3
4
4
4
4
5
6
7
7
8
9
10
10
11
11
12
V

PROCESS FOR THE CONTINUOUS WET TREATMENT OF TEXTILE MATERIAL IN ROPE FORM

The present invention relates to a process for the continuous wet treatment of textile material in rope form.

For a long time there have been attempts in industry to develop a continuous process for the wet treatment of any kind of textile material in rope form, for example piece goods, or for yarn hanks from a warp beam. Still greater problems have to be overcome in a continuously operated wet treatment of tows and combed material since such a material readily tends to break and form bulky lumps.

A dyeing process, according to which textile material in rope form is first impregnated and then the wet material is to be introduced into a pressure container through a sealing element, cannot be put into practice in this form as both impregnation would be irregular, no matter what chemical agents or dyes would be used, and when introduced in wet condition, the impregnation bath would inevitably be stripped off in an uncontrollable manner at the sealing elements.

Industry is, however, keenly interested in continuously operated treatment methods for textiles in rope form since these are able substantially to rush the wet treatment and thus to replace the conventional, discontinuous methods by profitable ones.

It has now been found that textile material even in rope form can be penetrated regularly at all points by a wet treatment liquor under elevated pressure, i.e. by operating under high temperature conditions, which again require the necessity of establishing the necessary high pressure for this process. For this purpose, the fibrous material impregnated with the liquor is continuously introduced in the form of an endless rope through several pressure locks into a storage system where it is allowed to dwell for a short time under high temperature conditions, and then withdrawn therefrom through pressure locks of the same type as mentioned.

This invention provides a continuous process for the wet treatment of textile material in the form of endless ropes and for dwelling the textile a certain period under high temperature (HT) conditions, which comprises introducing the material in curls into the long leg of a vertically positioned, U-shaped tubular tunnel having legs of different length, impregnating the textile under atmospheric pressure with hot treatment liquor that is ejected at a high flow rate by means of spraying nozzles which are positioned at the top and at additional locations further down the descending long leg of the tubular tunnel, conveying the textile along the bent portion of the tubular tunnel under the hydrostatic pressure exerted on the material by the weight of the liquid column in the long leg, conveying the textile from the short leg of the tubular tunnel into a pressure-tight reaction and fixing cchamber, allowing the textile to dwell during its passage through the reaction and fixing chamber under the action of a HT vapor atmosphere in stored condition, and finally withdrawing the textile from the reaction and fixing chamber through at least two other pressure locks.

To enable the new process of the invention to be carried out without using a roller lock for the material inlet, impregnation is made, though with a hot liquor, under atmospheric pressure. The textile material enters the impregnation tube as a tightly packed rope and is laid in curls (helical) therein by means of a trunk rope piler. In the simplest case, the impregnation tube is a U-shaped tube having a diameter of from 20 to at most 50 cm, preferably from 30 to 40 cm, and the length of the longer leg ranges from 5 to 6 meters. At the entrance of the long leg, this U-shaped tube is equipped with spraying nozzles suitable for the wet treatment of the textile material, which spray tangentially with regard to the transport direction of the rope material. The material is wetted in a very short time owing to the high ejection speed of the liquor, while moving slowly downward. The rope material is thus impregnated with the liquor at a determined goods-to-liquor ratio.

In many cases, the impregnation mechanism of the invention consists of a nozzle head placed in the middle of the U-shaped tube and suitable to eject the treatment liquor, preferably a hot dyeing liquor, under high pressure against the wall of the tube. The thin jet produced by the nozzle allows the liquor to be atomized and prevents the material from falling down vertically. Although the material is tightly packed, thus filling the tube to capacity, the curls remain in well arranged order. Instead of the above-mentioned nozzle head, the long leg of the U-shaped tube may also be centrically equipped with a small pipe provided with nozzles, which reaches from the top down to the beginning of the last third of the U-shaped tube. In this case, the ejected liquor is steadily sprayed, as it is by the nozzle head, against the rope material laid in curls which steadily moves along the tube.

According to another embodiment, the U-shaped tube may be equipped with circular nozzles in its interior, which serve to penetrate the curled rope material and to carry it along.

As the U-shaped tube, which is heated indirectly and entirely, has always two legs of different length so as to have, in the extreme case, the shape of a J-box or a "bleaching boot," the water column in the long leg will generally exert a hydrostatic pressure of from 1.5 to 1.6 bars (corresponding to 0.5 to 0.6 atmsg.) on the material at the bottom of the U-shaped tube, thus assuring a satisfactory penetration of the fibrous material (flooding process) and also shorter fixing times.

Definite fixation (the diffusion phase) is performed in a pressure container, i.e. the reactor as such, for example a steamer, into which the rope material is introduced through two or more inlet locks that are placed one behind the other and have a graduated pressure.

In this pressure chamber, for example the dyestuff is fixed, while the material is stored therein for a certain time, in a very gentle manner using high-pressure steam of from 1.5 to 5 bars. The pressure generally ranges from 2 to 3 bars, preferably from 2.4 to 2.7 bars, corresponding to a temperature of from 126° to 130° C, the dwelling period in this container, which serves as a fixing chamber, ranging from 15 to 45 minutes.

The U-shaped tube and the storage tank will always have such a capacity as to permit a fully continuous treatment of the material contained and steadily moved therein, for example a finishing process of the fibrous material. The U-shaped tube holds about 150 meters of the material in rope form; the reactor contains from 200 to 400 m, depending on its size. At a transport speed of 30 m per minute, the overall dwelling time for the rope material ranges from 12 to 18 minutes; at a transport speed of 20 m per minute, the maximum dwelling time ranges from 27 to 28 minutes. The dyestuff can therefore be fixed without difficulty. As the material is dyed continuously, however according to the exhaust method, the production rates obtained are very high.

The outlet from the dwelling chamber is either formed by the same number of pressure locks as is the inlet into it, or the outlet locks are preceded by a smaller pressure box, or a pressure chamber. Part of the pressure residing in the interior of the fixing chamber is generated by the preceding U-shaped tube. Hence, the inlet need not be equipped with as many pressure locks as the outlet. An unheated pressure chamber attached to the outlet from the fixing chamber therefore serves for the cooling of the material and as another pressure-reducing chamber. A washing tub, a J-box, a roller tub or a V-shaped washing compartment is used to end the dyeing operation. In the same or a slightly modified version, this process is also applicable to the boiling, bleaching and desizing operations. It also allows two methods to be united or to be performed immediately one after the other in the same installation.

An advantage of the process of the invention is that textile flat structures can continuously be worked in rope form without adverse effect to their textile properties. It is especially worth mentioning that knot and woven fabrics as well as yarns, during a remarkably short period after the exhaust method, can be exposed to a wet treatment and then to the action of heat. For this purpose, there are mentioned, above all, textile articles made of synthetic fibers or blends thereof with natural fibers, which usually require longer dyeing and fixing periods and higher dyeing temperatures than those made of natural fibers only. Fibers and filaments of polyamide, polyacrylonitrile or linear polyester material are especially useful. In addition, this dyeing process can also be applied for the continuous treatment of bast, cellulose fibers and wool.

The new process for the continuous wet treatment of textile rope material is, above all, suitable for the production of dyeings, using either water-soluble or water-insoluble products, such as vat dyes and "hot-dyeing" reactive dyes, moreover sulfur dyes, sulfur vat dyes and soluble sulfur dyes, preferably disperse dyes. Such dyes are known from Colour Index, 3rd edition (1971) under the classifications "Vat Dyes", "Solubilised Sulphur Dyes", "Solubilised Vat Dyes", "Reactive Dyes", "Basic Dyes", "Acid Dyes" (including metal complex compounds) and "Disperse Dyes".

The apparatus of the invention is illustrated diagrammatically by way of example in the accompanying drawing.

In this drawing, the reference numbers given have the following meanings:

FIG. 1 represents the rope material,

FIG. 2 represents a trunk rope piler,

FIG. 3 represents a U-shaped tube or a J-box (as impregnation container and flooding chamber), FIG. 4 represents circular spraying nozzles for injecting the liquor (from circulating pump and preparation container-provided with quantity control), FIG. 5 represents a liquor draining valve (after concentration, recycling toward the circulating pump), FIG. 6 represents a pressurized dwelling chamber (as a reaction and fixation chamber), with connection and draining pipes (not shown) for HT steam and hot air, FIG. 7 represents a pressure lock to let in the rope material, FIG. 8 represents a coveying winch, FIG. 9 represents the inclined floor of the chamber suitable for the storage of the material, FIG. 10 represents guiding rollers, FIG. 11 represents a pressure lock to let out the rope material, and FIG. 12 represents a withdrawing roller.

The operations to be performed under the HT conditions according to the process of the invention are carried out using pressure locks for the rope material. These may have the shape of a common shell of two frusta linked to each other by their top surfaces. Pressure locks of this type are disclosed in applicant's copending Patent Application Ser. No. 716,242.

The following Example illustrates the invention.

EXAMPLE

Pre-stabilized fabric made of 100% polyacrylonitrile fibers in rope form is introduced in curls into the long leg of a U-shaped tube (J-box) by means of a trunk rope piler and impregnated by means of spraying nozzles positioned in this tube with an aqueous liquor containing 17 g/1 of the dyestuff Basic Red 18, C.I. No. 11085,
8 cc/l of acetic acid (60 %), and
10 g/l of crystallized sodium acetate.

The temperature of the liquor is 65° C. Its quantity is such that one weight unit of the fabric introduced corresponds to two weight units of liquor. The liquor, which may gather at the bottom of the U-shaped tube, is suctioned off and after concentration recycled together with new liquor to the spraying nozzles.

Through two pressure locks at graduated pressure, positioned at the end of the short leg of the U-shaped tube, the impregnated material is then conducted into the dwelling chamber where it is steamed at 120° C under a pressure of about 2 bars. At a given transport speed of 25 meter per minute, at a U-shaped tube capacity of 150 m and a dwelling chamber capacity of about 300 m, the overall dyeing period is 18 minutes. Through another set of pressure locks of the same type, the rope material is then withdrawn from the dwelling chamber and rinsed until clear with water in a washing machine having several compartments, first in hot water of 80° C, then in cold water.

A level, intensely red dyeing is obtained on the polyacrylonitrile fabric.

I claim:

1. A continuous process for the wet treatment of textile material in the form of endless ropes and for dwelling the textile a certain period under high temperature (HT) conditions, which comprises introducing the material in curls into the long leg of a vertically positioned, U-shaped tubular tunnel having legs of different length, impregnating the textile under atmospheric pressure with hot treatment liquor that is ejected at a high flow rate by means of spraying nozzles which are positioned at the top and at additional locations further down the descending long leg of the tubular tunnel, conveying the textile along the bent portion of the tubular tunnel under the hydrostatic pressure exerted on the material by the weight of the liquid column in the long leg, conveying the textile from the short leg of the tubular tunnel into a pressure-tight reaction and fixing chamber through at least two pressure locks placed one behind the other at the entrance of the reaction and fixing chamber, allowing the textile to dwell during its passage through the reaction and fixing chamber under the action of a HT vapor atmosphere in stored condition, and finally withdrawing the textile from the reaction and fixing chamber through at least two other pressure locks.

* * * * *

UNITED STATES PATENT AND TRADEMARK OFFICE

CERTIFICATE OF CORRECTION

PATENT NO. : 4,041,559

DATED : August 16, 1977

INVENTOR(S) : Hans-Ulrich von der Eltz

It is certified that error appears in the above-identified patent and that said Letters Patent are hereby corrected as shown below:

In the Heading, Item [30], after "Foreign Application Priority Data," change "August 23, 1973" to --August 23, 1975--.

Signed and Sealed this

*Twenty-fifth* Day of *October 1977*

[SEAL]

*Attest:*

RUTH C. MASON
*Attesting Officer*

LUTRELLE F. PARKER
*Acting Commissioner of Patents and Trademarks*